US005499560A

United States Patent [19]

Aeschliman

[11] Patent Number: 5,499,560

[45] Date of Patent: Mar. 19, 1996

[54] UNIVERSAL OPEN ENDED SOCKET WRENCH

[76] Inventor: William M. Aeschliman, 604 Parkway Dr., Gladwin, Mich. 48624

[21] Appl. No.: 246,757

[22] Filed: May 20, 1994

[51] Int. Cl.[6] ..... B25B 13/46

[52] U.S. Cl. ..... 81/63.2; 81/177.2

[58] Field of Search ..... 81/60–63.2, 124.3, 81/177.2

[56] References Cited

U.S. PATENT DOCUMENTS

| | | | |
|---|---|---|---|
| 429,034 | 5/1890 | Justice . | |
| 608,866 | 9/1898 | Jones . | |
| 2,869,410 | 1/1959 | Prichard | 87/63 X |
| 3,877,328 | 4/1975 | Sullivan | 87/124.3 X |
| 4,003,275 | 1/1977 | Smith . | |
| 4,259,883 | 4/1981 | Carlson . | |
| 4,873,899 | 10/1989 | Mazurek | 87/63 |
| 5,295,422 | 3/1994 | Chow | 87/124.3 |

*Primary Examiner*—James G. Smith

*Attorney, Agent, or Firm*—Reising, Ethington, Barnard & Perry

[57] ABSTRACT

An open ended ratchet drive socket wrench (10) and different sized drive sockets (34, 34') provide for connecting and disconnecting nuts of different diameters to studs of different diameters and lengths; each of the drive sockets has a hexagonal fitting (40, 40') on one end that extends outwardly of the head of the wrench for providing clearance between the workpiece and the wrench and to connect to a nut on a stud and wherein each of the different sized sockets has a connector end (35, 35") on the opposite end thereof that extends through the head for connection thereto and for ratchet drive thereby and wherein the connector end (35, 35') has an opening (**40*a*, 40*a*'**) therethrough that will clear stud sizes for nuts tightened thereby and the single open ended socket wrench has a stepped bushing that will universally accommodate different sized hexagonal fittings.

1 Claim, 2 Drawing Sheets

10
12
14
14a
16
18
20
22
23
24
25
25a
25b
26
28
30
32
32a
32b
32c
32d
32e
33
33a
33b
33c
42
44
46
2
3

Fig.7
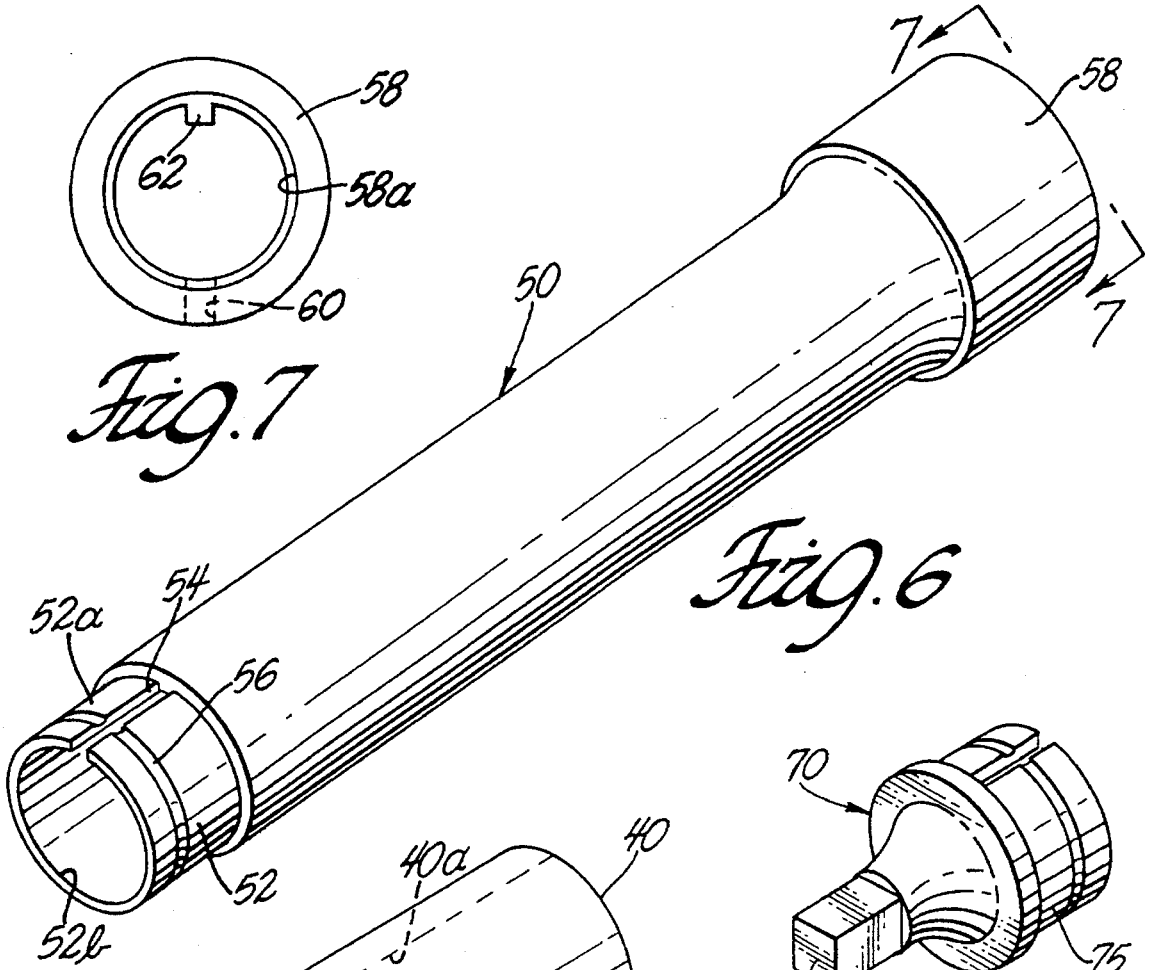
Fig.6
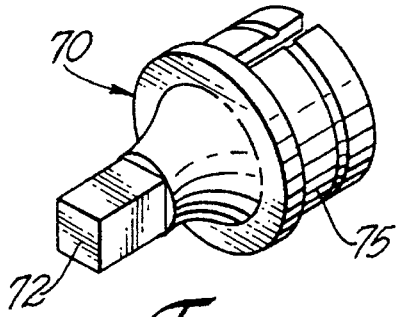
Fig.8
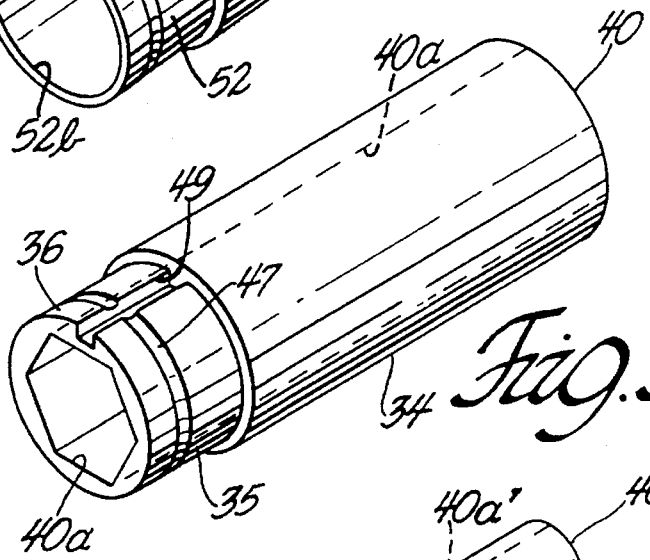
Fig.9
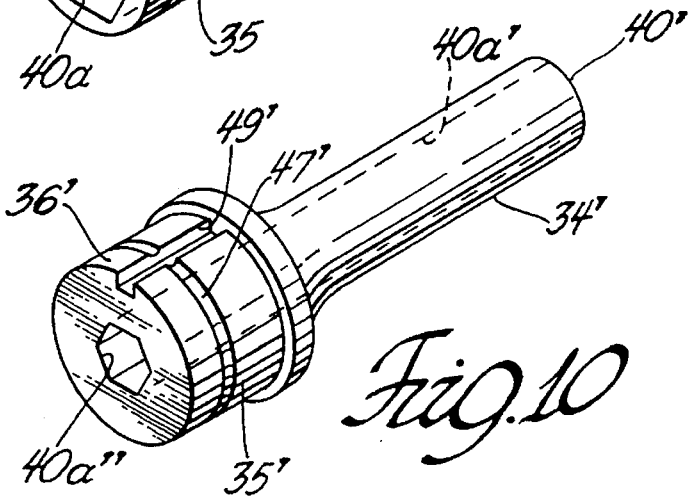
Fig.10
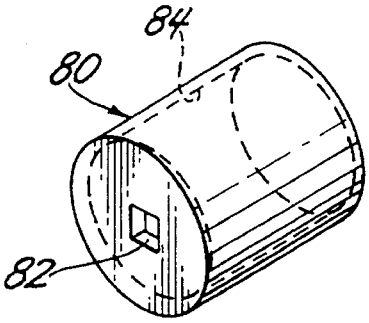
Fig.11

UNIVERSAL OPEN ENDED SOCKET WRENCH

FIELD OF THE INVENTION

This invention relates to socket wrenches and more particularly to open ended ratchet drive socket wrenches for connecting nuts to elongated studs.

BACKGROUND OF THE INVENTION

Various socket wrenches have been proposed for tightening a nut on a threaded member that extends through the head of the wrench. In each case the socket element that is connected to the head of the wrench limits the diameter of the elongated stud that is directed through the head of the wrench. In U.S. Pat. No. 429,034, the socket is configured to receive only one size screw matched to the size of the socket head. The wrenches in U.S. Pat. Nos. 608,866 and 4,259,883 are drop-in sockets that do not provide side clearance between the wrench head and the workpiece.

U.S. Pat. No. 4,003,275 shows a socket wrench with a combination ratchet ring and support collar that is adapted to receive a tubular end of a socket element. The support collar includes a post that extends into the head of the socket element so as to limit the size of the threaded stud that will fit through the socket element.

As a result, a single wrench head is unable to universally drive a wide range nut sizes while providing side clearance as found in standard socket wrench sets including ¼", ⅜" and ½" socket sizes.

The prior art wrenches, while able to screw a nut on a threaded member extending through the head of the wrench, have not been able to use a single wrench head with sockets having hex drive fittings that provide the side clearance of standard ¼", ⅜" and ½" socket sets.

SUMMARY OF THE INVENTION

It is therefore an object of the present invention to provide a ratchet drive socket wrench and socket combination that will enable a socket wrench with side clearance to be used for connecting and disconnecting nuts of different diameters to studs of different diameters and lengths.

A feature of the invention is that the socket wrench includes a stepped bushing adapted for use with each of a plurality of drive sockets having a hexagonal fitting on one end that extends outwardly of the head of the wrench for providing clearance between the workpiece and the wrench and to connect to a nut on a stud and wherein each of the different sized sockets has the same size connector end on the opposite end thereof that extends through the head for connection thereto and for ratchet drive thereby and wherein the connector end has an opening therethrough that will clear stud sizes corresponding to the nut tightened thereon and wherein the stepped bushing will universally accommodate different sized hexagonal fittings.

A further feature of the present invention is to provide an extension adapter for use in combination with such a stepped bushing including a sleeve thereon that will couple to the stepped bushing and that will clear a full range of studs having nuts tightened thereon.

These and other objects, advantages and features of the present invention will become more apparent from the following detailed description of the invention when taken in conjunction with the accompanying drawings.

BRIEF DESCRIPTION OF THE DRAWINGS

FIG. 6 is a perspective view of a socket extension used in the present invention;

FIG. 7 is an end elevational view taken along the line 7—7 of FIG. 6, looking in the direction of the arrows;

FIGS. 8 is a perspective view of an adapter to connect a standard socket component to the present invention;

FIGS. 9 and 10 are perspective views of sockets of the present invention including the wrench coupling end of the present invention thereon; and FIG. 11 is an adapter for connecting a swivel socket to the extension of FIG. 6.

DESCRIPTION OF A PREFERRED EMBODIMENT OF THE INVENTION

Figures 1, 2, 3, 4, 5:
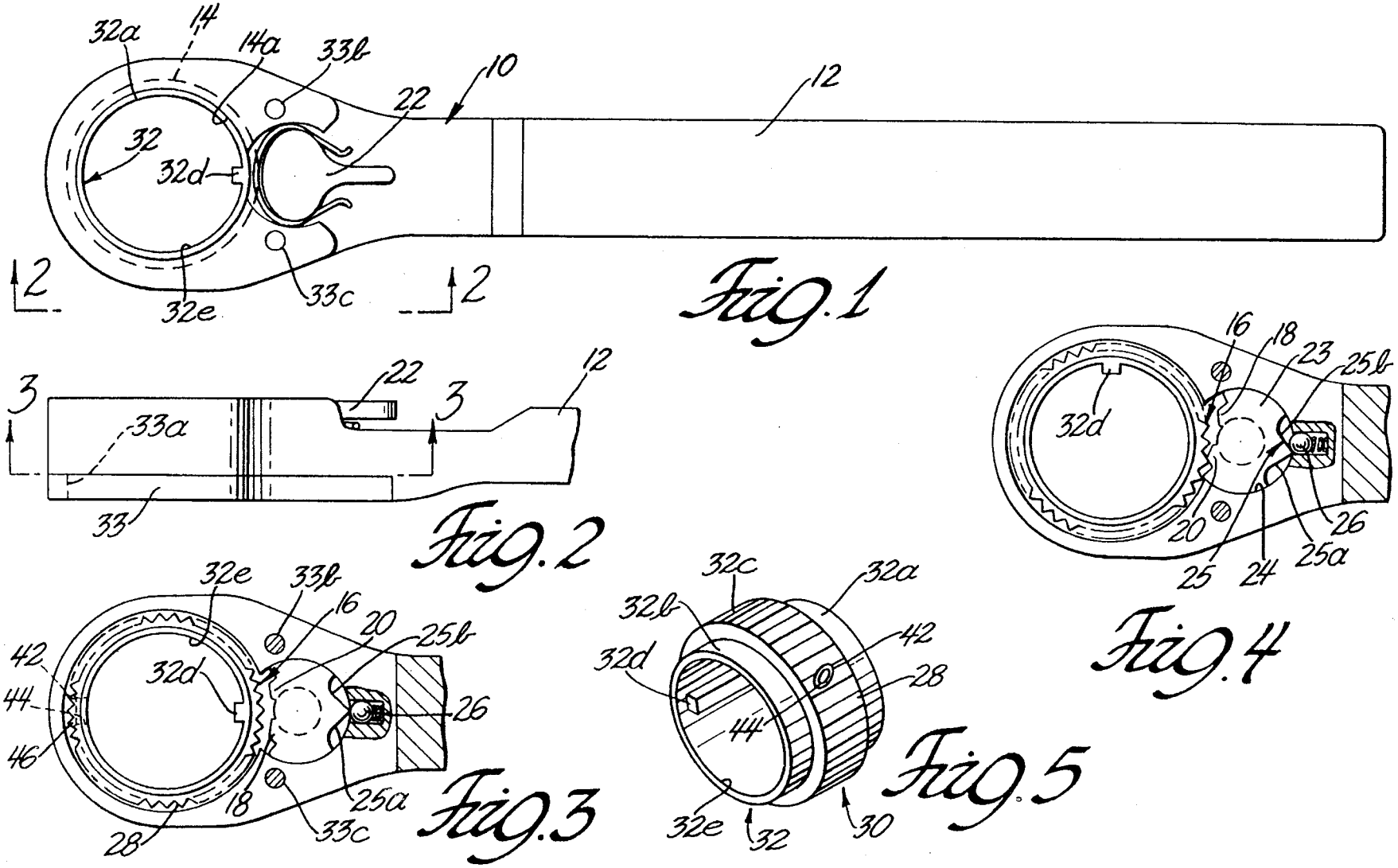
FIG. 1 is a top elevational view of an open ended ratchet driven socket wrench of the present invention.
FIG. 2 is a fragmentary side elevational view taken along the lines 2—2 of FIG. 1, looking in the direction of the arrows.
FIG. 3 is a sectional view taken along the line 3—3 of FIG. 1, looking in the direction of the arrows, showing the ratchet in a neutral position.
FIG. 4 is a view like FIG. 3 showing the ratchet set for counterclockwise drive of a nut.
FIG. 5 is a perspective view of a combination bushing and ratchet drive ring of the present invention.

In one embodiment of the invention, an open ended socket wrench 10 includes a handle 12 and a head portion 14. The head portion 14 houses a reversible ratchet drive 16 that is shown in FIGS. 3 and 4. The drive 16 more particularly includes two spaced, spring biased pawls 18, 20 that are positioned by a lever 22 having a shaft portion 23 that rotates in a bore 24 in the head portion 14. The shaft portion 23 is indented at 25 to form seats **25*a*, 25*b* for a spring biased ball detent 26. When the lever 22 is in a neutral position, the ball detent 26 is centered as shown in FIG. 3 whereby pawls 18, 20 are located out of interlocked relationship with drive teeth 28 on a ratchet wheel 30**.

When the lever 22 is moved to a drive position, either clockwise or counterclockwise, the ball detent 26 is seated in either seat **25*a* or 25*b* so that one or the other of pawls 18, 20 will engage the teeth 28 to prevent rotation of the wheel 30** in one direction while the released pawl is free to spring over the teeth in the opposite direction. Thus, the ratchet drive is reversible depending upon whether it is desired to tighten or loosen a nut on a threaded member.

While tooth type pawls are illustrated, it should be recognized that any reversing pawl arrangement is suitable for use with the invention including, but not limited to, lever type pawls, spring type pawls that are self biasing; and the wheel teeth can take many forms including the ratchet type tooth forms shown in the '034 patent and the '866 patent as well as teeth with overhanging lips as shown in the '883 patent or the straight flanked teeth of the present invention in each case the teeth will release over one of the pawls (when in a non-neutral drive position) and will lock against the other of the pawls depending upon the direction of ratchet drive that is selected.

In the past, such ratchet drive wheels have directly connected to the coupling head of the socket element such that the hole through the socket element would limit the size of the screw that could be accommodated by the wrench head. In accordance with the present invention, the ratchet wheel 30 is a stepped bushing 32 having an inside diameter that will enable a socket member of the present invention to be held in place in the head portion without limiting the size of the screws that can be directed through the head portion when used in association with a wide range of socket sizes. The stepped bushing 32 has end portions 32*a* and 32*b* that fit through bores 14*a* and 33*a* formed in the head 14 and a closure plate 33 connected by screws 33*b*, 33*c* to the underside of the head 14. The drive teeth 28 are formed on a center portion 32*c* of the bushing 32 having an O.D. that is greater than that of the portions 32*a*, 32*b*. Consequently, the stepped bushing 32 is axially held within the head 14.

FIGS. 9 and 10 show a ¾" socket 34 and ⅜" socket 34' of the present invention. It should be understood that these are representative of a full set. Each socket is a different sized open ended drive socket that includes a tubular connector end 35, 35' having an O.D. surface 36, 36' that is located in a slip fit engagement within the I.D. surface 32*e* of the stepped bushing 32. The connector end 35, 35' has a length that extends through the stepped bushing 32 and includes an opening 40*a*, 40' therethrough that is dimensioned larger than the size of the threaded element that receives the nut that fits a preselected hexagonal fitting 40, 40' on the opposite end of the socket 34, 34'. The I.D. 32*e* of the stepped bushing 32 is sized to accommodate the full range of stud diameters for a given range of sockets that are used in association with the socket wrench 10.

In accordance with the invention, the standard connector end 35, 35' is interlocked to the stepped bushing 32 by a ball detent 42 carried in a hole 44 in the center portion 32*c*. A spring 46 biases the ball detent 42 outwardly into engagement with an annular groove 47, 47' in the O.D. of the coupling end 35, 35'. The standard coupling end 35, 35' is also drivingly interlocked with respect to the stepped bushing 32 during ratchet drive of the socket by a drive tooth 32*d* that is formed integrally of the stepped bushing 32 and extending radially inwardly thereof into interlocked relationship with a slot 49, 49' formed in the O.D. of the coupling end 35, 35'.

The hexagonal drive fitting 40, 40' has an opening 40*a*, 40*a'* that extends through the tubular connector end 35, 35'. The opening 40*a*, 40*a'* provides clearances between the stud diameter and the I.D. surface of the opening 40*a*, 40*a'* as shown in the following chart. The clearance is possible because of the "large throat" design of the I.D. surface 32*e* of the stepped bushing 32 of the invention. Such clearance of the invention provides for engagement of the head portion 14 with a nut for tightening same on a threaded element that is directed through the hexagonal drive fitting 40, 40' and the opening defined by the I.D. surface 32*e*. The opening through the I.D. surface 32*e* is sized, in accordance with the invention, to accommodate an extended range of stud diameters that can be extended through the head 14 and tightened merely by substituting the desired socket 34 of the present invention within the stepped bushing 32. The I.D. of the stepped bushing 32 is configured as shown in the following chart to accommodate a wide range of sockets 34 that clear their respective stud diameters while providing a hexagonal drive socket 40*a*, 40*a'* that is located outboard of the wrench 10 for spacing the wrench from the workpiece against which a nut is tightened.

| Hex Size | Stud to Wall Clearance at I.D. of Hex opening | Clearance Between Hex and I.D. of Bushing 32 |
|---|---|---|
| ¼" | Yes | Yes |
| ⅜" | Yes | Yes |
| ½" | Yes | Yes |
| ⅝" | Yes | Yes |
| ¾" | Yes | Yes |

Accordingly, the present invention provides for a wrench head that will accommodate a wide range of stud diameters merely by substituting one of the universally adaptable sockets 34 of the present invention in connected relationship with the head 14 of the wrench 10 of the present invention.

Another aspect of the invention is an extension adapter 50 shown in FIG. 6. The extension adapter 50 connects to the wrench head 12 without impairing the freedom to use any one of a plurality of different sized sockets 34 as representatively listed in the above chart.

The extension adapter 50 includes an adapter connector end including sleeve 52 on one end that has an O.D. surface 52*a* that slip fits into the I.D. surface 32*e* of the stepped bushing 32. An I.D. surface 52*b* extends through the adapter 50 to form a longitudinal opening therethrough. As in the other standard connectors, the sleeve 52 has a slot 54 formed therein that is engaged by the drive tooth 32*d* for interlocking the ratchet wheel 30 to the extension adapter 50 the same way the drive tooth engages the slots 49, 49' of the hexagopnal fitting 40, 40'. The sleeve 52 includes an annular groove 56 on its O.D. surface that is axially interlocked in the head portion 14 by the ball detent 42. The opposite end of the extension adapter 50 defines a adapter drive end that includes an tubular portion 58 that includes an I.D. surface 58*a* corresponding to the I.D. surface 32*e* of the stepped bushing 32. The opening defined by I.D. surface 52*b* and the I.D. surface 58 enable the full range of stud sizes to be passed through the extension adapter. The annular portion 58 has a ball detent 60 and an adapter drive tooth 62 that serve the same function as to like elements in the stepped bushing 32. Consequently, when the extension adapter 50 is used, each of the above-described connector ends 35, 35' can be connected thereto for reaching and tightening nuts at locations remote from the head portion 14.

FIG. 8 shows an adapter member 70 that has a connector end 75 corresponding to the connector end 35, 35' described above. The adapter member 70 carries a square tip 72 that is sized to fit in the head of a standard socket set such as standard ¼", ⅜" and ½" socket sets.

FIG. 11 shows an adapter member 80 that has an opening 82 that will fit over the square tip of a standard ¼, ⅜" or ½" inch socket set. The adapter member 80 further includes a socket 84 configured like the interior of the bushing 32 to receive the socket set described above.

While the invention has been described with respect to a preferred embodiment, it should be understood that various changes and modifications may be made without departing from the spirit and scope of the present invention as set forth in the following claims:

What is claimed is:

1. A tool kit including different sized open ended drive sockets, an extension adapter and an open ended socket wrench with a handle and a head with a bore therethrough:

said head having a stepped bushing with end portions fit in and extending through said bore and including a center head opening with a head drive tooth connected to said stepped bushing and extending radially into said center head opening;

each of said different sized open ended drive sockets being selectively connectable to said head by each of different sized open ended drive sockets having a driven connector end including a slot that receives said head drive tooth for interlocking said driven connector end to said head drive tooth; said different sized open ended drive sockets each having an opening for passage of a threaded member therethrough;

said extension adapter having an adapter connector end with a slot having the same configuration as said slot on each of said different sized open ended drive sockets and said slot on said adapter connector end engageable by said head drive tooth for interlocking said extension adapter to said head drive tooth; said adapter connector end slot selectively engageable with said head drive tooth when said different sized open ended drive sockets are disconnected therefrom; said extension adapter having an opening for passage of a threaded member through said extension adapter and said head;

said extension adapter having an adapter drive end; said adapter drive end having an adapter drive opening therein and an adapter drive tooth; said adapter drive opening and said adapter drive tooth having the same configuration as said head opening and said head drive tooth;

said adapter connector end on said extension adapter and said driven connector ends on said different sized open ended drive sockets having the same configuration for being universally selectively engageable by said head drive tooth and said driven connector ends on said different sized open ended drive sockets further being selectively engageable to said adapter drive end of said extension adapter when said adapter connector end of said extension adapter is engaged with said head drive tooth.

* * * * *

UNITED STATES PATENT AND TRADEMARK OFFICE

CERTIFICATE OF CORRECTION

PATENT NO. : 5,499,560
DATED : March 19, 1996
INVENTOR(S) : William M. Aeschliman It is certified that error appears in the above-indentified patent and that said Letters Patent is hereby corrected as shown below:

Abstract line 9, delete " 35" " and insert therefor -- 35' --.

In the Drawings:

Drawings, Figure 10, delete " 40a" " and insert therefor -- 40a' --.

Signed and Sealed this

Fourth Day of February, 1997

*Attest:*

Bruce Lehman

BRUCE LEHMAN

*Attesting Officer*

*Commissioner of Patents and Trademarks*